US010403991B2

(12) United States Patent
Takeuchi et al.

(10) Patent No.: US 10,403,991 B2
(45) Date of Patent: Sep. 3, 2019

(54) BOARD-TO-BOARD CONNECTOR WITH METAL FITTINGS AND GUIDE PORTIONS

(71) Applicant: Molex, LLC, Lisle, IL (US)

(72) Inventors: Ryotaro Takeuchi, Yamato (JP); Hiroki Ono, Yamato (JP); Naoto Sasayama, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/989,423

(22) Filed: May 25, 2018

(65) Prior Publication Data

US 2018/0277972 A1 Sep. 27, 2018

Related U.S. Application Data

(63) Continuation of application No. 15/068,851, filed on Mar. 14, 2016, now Pat. No. 9,985,366.

(30) Foreign Application Priority Data

Apr. 23, 2015 (JP) ..... 2015-088042

(51) Int. Cl.

| | |
|---|---|
| ***H01R 12/52*** | (2011.01) |
| ***H01R 12/70*** | (2011.01) |
| ***H01R 12/50*** | (2011.01) |
| *H01R 12/71* | (2011.01) |
| *H01R 12/00* | (2006.01) |

(52) U.S. Cl.

CPC ..... *H01R 12/707* (2013.01); *H01R 12/52* (2013.01); *H01R 23/7073* (2013.01); *H01R 23/725* (2013.01); *H01R 9/096* (2013.01); *H01R 12/7082* (2013.01); *H01R 12/716* (2013.01)

(58) Field of Classification Search

CPC ..... H01R 12/52; H01R 12/716; H01R 9/096; H01R 23/7073; H01R 23/725

See application file for complete search history.

(56) References Cited

U.S. PATENT DOCUMENTS

| | | | | |
|---|---|---|---|---|
| 7,585,185 | B2 | 9/2009 | Obikane | |
| 7,845,958 | B2 * | 12/2010 | Hoshino | H01R 13/6275 439/660 |
| 8,845,339 | B2 * | 9/2014 | Ono | H01R 12/7052 439/74 |

(Continued)

FOREIGN PATENT DOCUMENTS

| | | |
|---|---|---|
| JP | 2011-233527 A | 11/2011 |
| JP | 2013-206771 A | 10/2013 |

*Primary Examiner* — Abdullah A Riyami
*Assistant Examiner* — Justin M Kratt
(74) *Attorney, Agent, or Firm* — Molex, LLC

(57) ABSTRACT

A connector is provided which includes a main body, terminals mounted in the body, and a reinforcing metal fitting mounted in the body. The fitting includes a body secured to the mating guide portion, a pair of left and right connecting arm portions connected to the base end of the body, and a pair of left and right contact arm portions connected to the base end of the connecting arm portions. The fitting further includes a first connecting leg portion connected to a connecting pad on a board being connected at the upper end of the first connecting leg portion to the lower end or base end of each contact arm portion so as to have a substantially L-shaped profile when viewed from a side of the connector.

15 Claims, 11 Drawing Sheets

(56) References Cited

U.S. PATENT DOCUMENTS

| | | | | |
|---|---|---|---|---|
| 9,331,410 | B2 | 5/2016 | Obikane et al. | |
| 2014/0148022 | A1 | 5/2014 | Mongold et al. | |
| 2014/0256195 | A1 | 9/2014 | Obikane et al. | |
| 2014/0315419 | A1 | 10/2014 | Ishida et al. | |
| 2015/0079816 | A1 | 3/2015 | Suzuki et al. | |
| 2015/0214643 | A1* | 7/2015 | Lee ..... | H01R 12/7029<br>439/655 |

* cited by examiner

BOARD-TO-BOARD CONNECTOR WITH METAL FITTINGS AND GUIDE PORTIONS

RELATED APPLICATIONS

This application is a continuation of U.S. patent application Ser. No. 15/068,851, filed Mar. 14, 2016, now U.S. Pat. No. 9,985,366, which in turn claims priority to Japanese Application No. 2015-088042, filed Apr. 23, 2015, each of which are incorporated herein by reference in their entireties.

TECHNICAL FIELD

The present disclosure relates to a connector.

BACKGROUND ART

Board-to-board connectors are used to electrically connect a pair of parallel circuit boards. These board-to-board connectors are mounted on the surfaces of the pair of circuit boards facing each other, and then mated to establish an electrical connection. Reinforcing metal fittings have been proposed which are mounted on both ends to function as locking members for keeping the two connectors mated (see, for example, Patent Document 1).

In FIG. 11B, 851 is the first reinforcing metal fitting attached to both ends in the longitudinal direction of the housing of the first connector mounted on a first circuit board (not shown). In FIG. 11A, 951 is the second reinforcing metal fitting attached to both ends in the longitudinal direction of the housing of the second connector mounted on a second circuit board (not shown).

The first reinforcing metal fitting 851 is a component integrally formed by stamping and bending a metal sheet, and includes a panel-shaped main body portion 852 extending in the transverse direction of the first connector, a side engaging piece extending from both ends of the main body portion 852 in the longitudinal direction of the first connector, a first board connecting portion 856*a* connected to the bottom ends of the side engaging piece 858 and soldered securely to the first circuit board, a second board connecting portion 856*b* soldered securely to the first circuit board connected to the bottom end of the main body portion 852, and a housing engaging protruding portion 854 formed on the leading end of each side engaging piece 858.

The second reinforcing metal fitting 951 is a component integrally formed by stamping and bending a metal sheet, and includes a panel-shaped main body portion 952 extending in the transverse direction of the second connector, a side engaging piece 958 extending outward in the transverse direction of the second connector from both the left and right ends of the main body portion 952, a side engaging protruding portion 958*a* formed on the leading end of each side engaging piece 958, a board connecting portion 956 soldered securely to the second circuit board connected to the bottom end of the main body portion 952 (the upper end from the perspective of the drawing), and housing engaging protruding portions 952*a* formed on a surface of the main body portion 952.

When the first connector and the second connector are mated, the side engaging protruding portions 858*a* of the first reinforcing metal fitting 851 and the side engaging protruding portions 958*a* of the second reinforcing metal fitting 951 engage each other to lock the first connector and the second connector and keep them mated.

Patent Document 1: Laid-Open Patent Publication No. 2009-277365

SUMMARY

In a connector of the prior art, sufficient flexibility is not imparted to the side engaging pieces 858 of the first reinforcing metal fitting 851 because an electric current is not supposed to flow through the first reinforcing metal fitting 851 and the second reinforcing metal fitting 951. Therefore, when the first reinforcing metal fitting 851 and the second reinforcing metal fitting 951 are connected to the power lines of the first circuit board and the second circuit board, an electrical connection is established between the power line of the first circuit board and the power line of the second circuit board via the first reinforcing metal fitting 851 and the second reinforcing metal fitting 951, and the electrical device on which the first circuit board and the second circuit board are mounted is dropped and subjected to vibrations and impacts due to the external force, the electrical connection between the first reinforcing metal fitting 851 and the second reinforcing metal fitting 951 may be temporarily cut off.

The present disclosure provides a highly reliable connector able to extend the length of the spring to the section contacting the other reinforcing metal fitting by giving the connecting leg portion connected to the board a substantially L-shaped profile when viewed from the side of the connector, able to more reliably keep the reinforcing metal fitting and the other reinforcing metal fitting engaged with each other, and able to more reliably keep the reinforcing metal fitting and the other reinforcing metal fitting connected electrically.

The present disclosure provides a connector comprising a connector main body, terminals mounted in the connector main body, and a reinforcing metal fitting mounted in the connector main body; the connector main body including mating guide portions formed at both ends longitudinally and mating with the mating guide portion formed at both ends longitudinally in the connector main body of another connector; the reinforcing metal fitting including a main body portion secured to the mating guide portion, a pair of left and right connecting arm portions connected to the base end of the main body portion on both the left and right ends, extending in the longitudinal direction of the connector main body, and arranged outside of side wall portions of the mating guide portion, and a pair of left and right contact arm portions connected to the base end of the connecting arm portions at the upper end or leading end and contacting the reinforcing metal fitting mounted in the other connector main body; and a first connecting leg portion connected to a connecting pad on a board being connected at the upper end of the first connecting leg portion to the lower end or base end of each contact arm portion so as to have a substantially L-shaped profile when viewed from a side of the connector.

In another connector of the present disclosure, each first connecting leg portion includes a perpendicular portion extending in the vertical direction and a horizontal portion extending from the perpendicular portion outward in the longitudinal direction of the connector main body, the lower end of the horizontal portion being connected to the connecting pad.

In another connector of the present disclosure, a second connecting leg portion connected to a connecting pad on a board is connected at the upper end of the second connecting leg portion to the lower end of the main body portion so as to have a substantially L-shaped profile when viewed from a side of the connector.

In another connector of the present disclosure, each connecting arm portion has a width in the section in front of the front end of the first connecting arm portion greater than the width of the base end connected to the main body portion.

In another connector of the present disclosure, the width of each contact arm portion is greater than the width of the base end connected to the main body portion in the connecting arm portion.

In another connector of the present disclosure, the contact arm portion has a contact upper arm portion and a contact front arm portion, the contact upper arm portion including an upper covering portion connected at the base end to the upper end or leading end of a connecting arm portion and straddling at the leading end a side wall portion of the mating guide portion facing downward, and an inner covering portion connected to the leading end of the upper covering portion and arranged inside the mating guide portion, and the contact front arm portion being connected to the inner covering portion, arranged inside a side wall portion of the mating guide portion, and contacting the reinforcing metal fitting mounted on the other mating guide portion inserted into the mating recessed portion of the mating guide portion.

In another connector of the present disclosure, a barrier portion is formed in a side surface of the main body portion and the connecting arm portion to prevent the rise of solder or flux.

In another connector of the present disclosure, the side surface of the main body portion and the connecting arm portion are plated with an undercoating of nickel, and the nickel surface is exposed in a portion of the barrier portion by exposing the metal plating to a laser beam.

In the present disclosure, the connecting leg portion connected to a board has a substantially L-shaped profile when viewed from a side of the connector. Thus, reliability can be improved by enabling the length of the spring to be extended to the section contacting the other reinforcing metal fitting, by more reliably keeping the reinforcing metal fitting and the other reinforcing metal fitting engaged with each other, and by more reliably keeping the reinforcing metal fitting and the other reinforcing metal fitting connected electrically.

BRIEF DESCRIPTION OF THE DRAWINGS

FIGS. 1A and 1B are a pair of perspectives view of the first connector in an embodiment of the present disclosure in which FIG. 1A is a perspective view from above and FIG. 1B is a perspective view from below.

FIGS. 5A-5F are six views of the first reinforcing metal fitting in an embodiment of the present disclosure in which FIG. 5A is a front view, FIG. 5B is a side view, FIG. 5C is a rear view, FIG. 5D is a cross-sectional view from A-A in FIG. 5C, FIG. 5E is a top view, and FIG. 5F is a bottom view.

FIGS. 6A and 6B are a pair of perspective views of the second connector in an embodiment of the present disclosure in which FIG. 6A is a perspective view from above and FIG. 6B is a perspective view from below.

FIGS. 9A and 9B are a pair of perspective views of the connectors in an embodiment of the present disclosure after the mating process has been completed in which FIG. 9A is a view from the side of the second connector and FIG. 9B is a view from the side of the first connector.

FIGS. 10A and 10B are a pair of perspective views of the first reinforcing metal fitting and the second reinforcing fitting in an embodiment of the present disclosure after the mating process has been completed on the connectors in which FIG. 10A is a view from the side of the second connector and FIG. 10B is a view from the side of the first connector.

FIGS. 11A and 11B are a pair of perspective views of reinforcing metal fittings of the prior art in which FIG. 11A shows the second reinforcing metal fitting and FIG. 11B shows the first reinforcing metal fitting.

DETAILED DESCRIPTION OF THE PREFERRED EMBODIMENTS

Figure 1A:
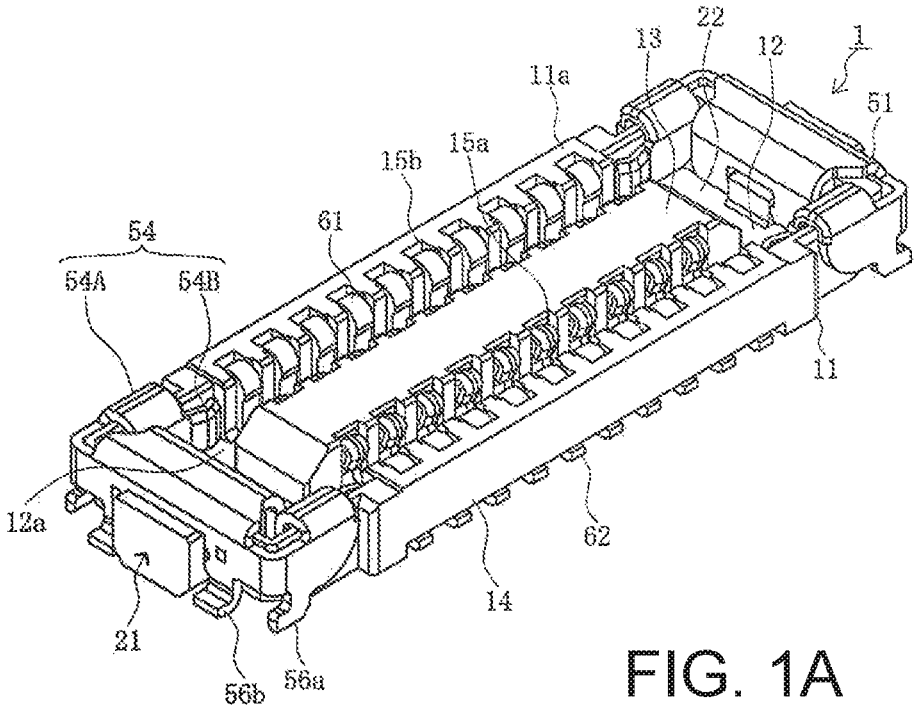

The following is a more detailed explanation of an embodiment of the present disclosure with reference to the drawings.

In the drawings, 1 is the first connector which is one of the pair of board-to-board connectors in the present embodiment. The first connector 1 is a surface mounted connector which is mounted on the surface of a first board (not shown), and mated with another connector or the second connector 101 described below. Also, the second connector 101 is the other one of the pair of board-to-board connectors in the present embodiment. This is also a surface mounted connector mounted on the surface of a second board (not shown).

The first connector 1 and the second connector 101 in the present embodiment preferably establish an electrical connection between the first board and the second board. The first board and the second board can also be printed circuit boards used in electronic devices, flexible flat cables (FFC), flexible printed circuit (FPC) boards, or any other type of board.

In the present embodiment, the expressions indicating direction, such as upper, lower, left, right, front and rear, which are used to explain the configuration and operation of each portion of the first connector 1 and the second connector 101, are relative and not absolute. They depend on the orientation of the connectors and their constituent components shown in the drawings. When the orientation of the first connector 1, the second connector 101 or their constituent components changes, the interpretation changes in response to the change in orientation.

The first connector 1 has a first housing 11, which is an integrally molded connector main body made of an insulating material such as a synthetic resin. As shown in the drawings, the first housing 11 has a rectangular thick panel-like shape, and has a rectangular recessed portion 12 with a surrounded perimeter formed on the side receiving the inserted second connector 101, that is, the mating surface 11*a* side (the upper side in FIG. 2). A first protruding portion 13 is integrally formed inside the recessed portion 12 of the first housing 11 as an island. Side wall portions 14 are integrally formed with the first housing 11 and extend parallel to the first protruding portion 13 on both sides of the first protruding portion 13.

Here, the first protruding portion 13 and the side wall portions 14 protrude upward from the bottom surface of the recessed portion 12, and extend in the longitudinal direction of the first housing 11. A slender recessed groove portion 12*a* extending in the longitudinal direction of the first housing 11 is formed as a section of the recessed portion 12 on both ends of the first protruding portion 13.

Here, a groove-shaped first terminal accommodating inner cavity 15*a* is formed on both side surfaces of the first protruding portion 13. A groove-shaped first terminal accommodating outer cavity 15*b* is also formed on both inside surfaces of the side wall portions 14. The first terminal accommodating inner cavity 15*a* and first terminal accommodating outer cavity 15*b* are connected to and integrated with the bottom surface of the recessed groove portion 12*a*. When the first terminal accommodating inner cavity 15*a* and the first terminal accommodating outer cavity 15*b* are explained collectively, they will be referred to simply as the first terminal accommodating cavities 15.

In the present embodiment, first terminal accommodating cavities 15 are formed side by side in the longitudinal direction of the first housing 11 on both sides of the first housing 11 in the transverse direction. More specifically, a plurality are formed on both sides of the first protruding portion 13 at a predetermined pitch. The first terminals 61 accommodated inside each of these first terminal accommodating cavities 15 are also arranged on both sides of the first protruding portion 13 at the same pitch.

Each first terminal 61 is an integrally formed component obtained by stamping and bending a conductive metal sheet, and includes a held portion 63, a tail portion 62 connected to the lower end of the held portion 63, an upper connecting portion 67 connected to the upper end of the held portion 63, a second contact portion 66 formed near the inside end of the upper connecting portion 67, a lower connecting portion 64 connected to the second contact portion 66, and a first contact portion 65 formed near the free end of the lower connecting portion 64.

The held portion 63 extends vertically, that is, in the thickness direction of the first housing 11, and is inserted into and held by a first terminal accommodating outer cavity 15*b*. The tail portion 62 is curved and connected to the held portion 63, extends to the outside in the transverse direction, that is, in the width direction of the first housing 11, and is connected using, for example, solder to a connecting pad linked to a conductive trace in the first board. The conductive trace is typically a signal line. The upper connecting portion 67 is curved and connected to the held portion 63, and extends inward in the transverse direction of the first housing 11.

A second contact portion 66 is formed on the inner end of the upper connecting portion 67 so as to bend downward and protrude inward in the transverse direction of the first housing 11. The lower connecting portion 64 has a U-shaped lateral profile and is connected to the second contact portion 66. A first contact portion 65 is formed near the free end of the lower connecting portion 64, that is, near the upper end to the inside, is bent into a U-shape, and protrudes outward in the transverse direction of the first housing 11.

Figure 3:
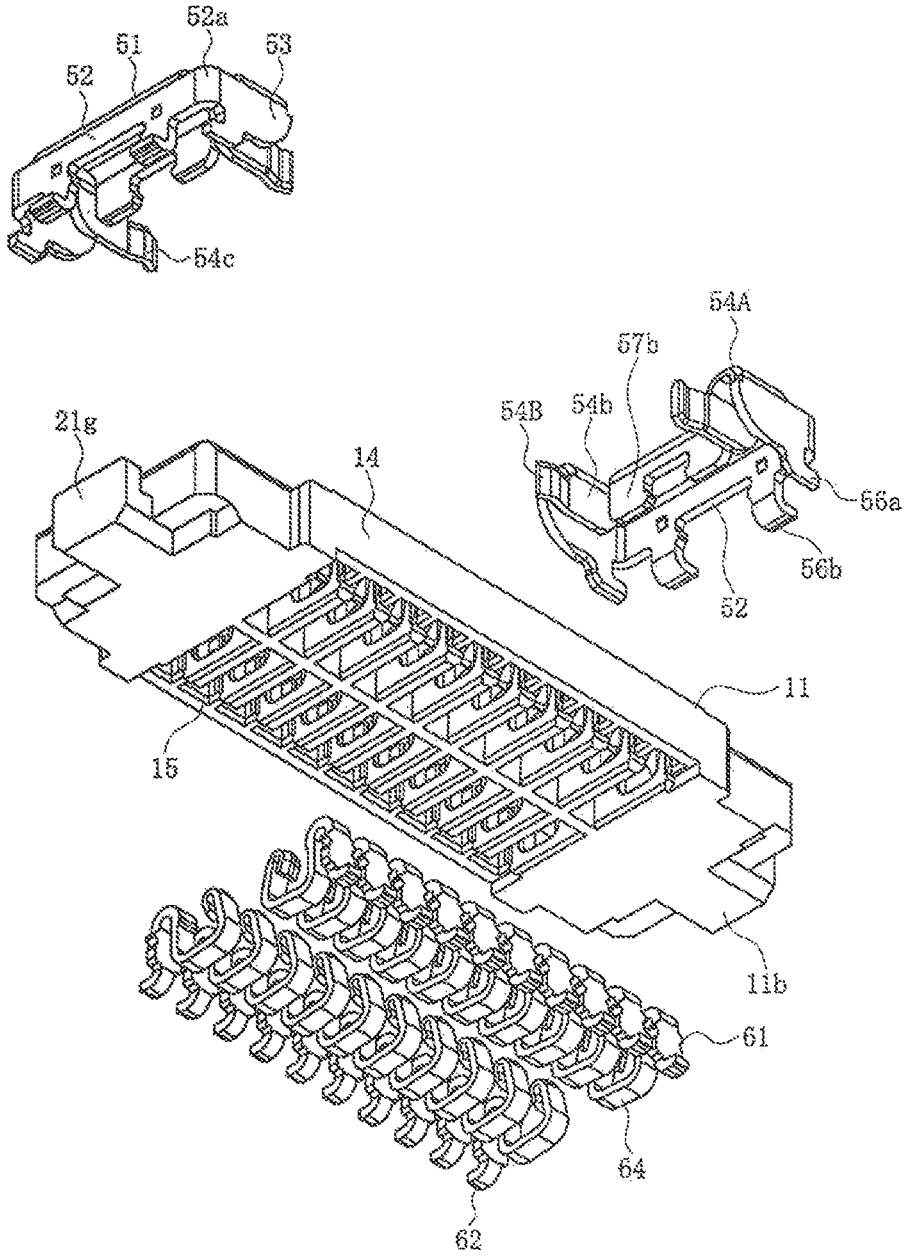
FIG. 3 is an exploded perspective view from below of the first connector in an embodiment of the present disclosure.

Each first terminal 61 is fitted into a first terminal accommodating cavity 15 from the mounting surface 11*b* (the lower end in FIG. 3), and the held portion 63 is clamped on both sides by the side wall of the first terminal accommodating outer cavity 15*b* formed in the inside surfaces of the side wall portion 14 to secure the first housing 11. When the first terminal 61 is mounted in the first housing 11, the first contact portion 65 and the second contact portion 66 are positioned to the left and right of the recessed groove portion 12*a* and face each other.

Because each first terminal 61 is an integrally formed component obtained by machining a metal strip, it has elasticity. It is clear from the shape that the first contact portion 65 and the second contact portion 66 face each other and are elastically displaceable. In other words, when a second terminal 161 on the second connector 101 is inserted between the first contact portion 65 and the second contact portion 66, the gap between the first contact portion 65 and the second contact portion 66 is extended elastically.

First protruding end portions 21 serving as mating guide portions are arranged at both ends of the first housing 11 in the longitudinal direction. A mating recessed portion 22 is formed in a section of the recessed portion 12 of each first protruding end portion 21. Each mating recessed portion 22 is a recessed portion with a rectangular profile, and is connected to both ends of each recessed groove portion 12*a* in the longitudinal direction. When the first connector 1 and the second connector 101 have been mated, the mating recessed portions 22 receive the inserted second protruding end portions 122 of the second connector 101 described below.

The first protruding end portion 21 includes a side wall extending portion 21*c* serving as a side wall portion of the first protruding end portion 21 which extends from both longitudinal ends of the side wall portions 14 in the longitudinal direction of the first housing 11, and end wall portions 21*b* extending in the transverse direction of the first housing 11 and connected to a side wall extending portion 21*c* on both ends. In each first protruding end portion 21, the end wall portions 21*b* and the side wall extending portions 21*c* connected at both ends create a continuous side wall with a squared-off C-shaped profile and define three sides of a mating recessed portion 22 with a rectangular profile.

A first reinforcing metal fitting 51 is attached to the first protruding end portion 21. The first reinforcing metal fitting 51 is accommodated inside and held by the first metal fitting holding recessed portion 26 formed in the first protruding end portion 21. The first metal fitting holding recessed portion 26 has a squared-off C-shaped profile when viewed from the mating surface side. The upper surface 21*a* of the first protruding end portion 21 is open, and a slit-like space extends from the upper surface 21*a* downward in the thickness direction of the first housing 11.

The squared-off C-shaped side wall formed by the end wall portion 21*b* and the side wall extending portions 21*c* is divided by the first metal fitting holding recessed portion 26 into an inner wall portion 21*f* and an outer wall portion 21*k*. The inner wall portion 21*f* has a squared-off C-shaped profile and is connected to both longitudinal ends of the side wall portion 14. The outer wall portion 21*k* exists only in the section corresponding to the central area of the end wall portion 21*b*, and is missing in the section corresponding to the ends of the end wall portion 21*b* and the section corresponding to the side wall extending portions 21*c*. The first metal fitting holding recessed portion 26 includes first connecting arm portion accommodating openings 26*e* which open into the outer surface of the end wall portion 21*b* and correspond to the ends of the end wall portion 21*b*, and a second connecting arm portion accommodating opening 26*a* which opens into the outer surface of the side wall extending portions 21*c* and correspond to the side wall extending portions 21*c*. The outer wall surfaces of the central portion 21*g* of the outer wall portions 21*k* are the outermost side walls in the longitudinal direction of the first housing 11.

An inner end protruding portion 25 is formed on the inner wall portion of each end wall portion 21*b* and extends towards the first protruding portion 13. The opposing flat surface 25*a* of the inner end protruding portion 25 facing the first protruding portion 13 is a flat surface functioning as a reference surface for positioning of the various components of the first connector 1 relative to the longitudinal direction of the first housing 11.

The first reinforcing metal fitting 51 is an integrally formed component obtained by stamping and bending a metal sheet, and includes a first main body portion 52 secured to the central portion 21*g* of the outer wall portion 21*k* of the first housing 11, a connecting arm portion 53 connected to both ends of the first main body portion 52, a contact arm portion 54 connected to the connecting arm portions 53, and a central guide portion 57 connected to the upper end of the first main body portion 52. Each contact arm portion 54 has a contact upper arm portion 54A connected to a connecting arm portion 53 and a contact front arm portion 54B connected to the contact upper arm portion 54A.

The first main body portion 52 is a slender, band-shaped member extending entirely in the transverse direction of the first housing 11. Both the left and the right end are curved and connected to the first main body portion 52, and the leading ends or corner portions 52*a* extend inward in the longitudinal direction of the first housing 11. Therefore, the first main body portion 52 including the corner portion 52*a* on both ends has a squared-off C-shaped profile in plan view, that is, when viewed from above.

A second connecting leg portion 56*b* is connected to the first board at the lower end of the first main body portion 52. The second connecting leg portion 56*b*, near the upper end, as in the case of the first main body portion 52, extends vertically (in the thickness direction of the first housing 11). However, it is bent in the middle and the leading end faces outward in the longitudinal direction of the first housing 11 so as to have a substantially L-shaped profile when viewed from the side of the first connector 1. The leading lower end of the second connecting leg portion 56*b* is connected using, for example, solder to a connecting pad linked to a conductive trace in the first board. The conductive trace is typically a signal line.

A connecting arm portion 53 is connected to the leading end of the corner portion 52*a*. The connecting arm portion 53 has a flat plate-like portion extending in the longitudinal direction and in the thickness direction of the first housing 11. A first connecting leg portion 56*a* connected to the first board is also connected to the lower base end, and a connecting upper arm portion 54A is connected to the upper leading end.

The first connecting leg portion 56*a*, as in the case of the connecting arm portion 53, is a flat plate-like portion extending in the longitudinal direction and in the thickness direction of the first housing 11 for a substantially L-shaped profile when viewed from the side of the first connector 1. More specifically, the first connecting leg portion 56*a* extends in the vertical direction (that is, in the thickness direction of the first housing 11), and incudes at the upper end a perpendicular portion 56*a*1 connected to the connecting arm portion 53 and a horizontal portion 56*a*2 extending from the lower end of the perpendicular portion 56*a*1 outward in the longitudinal direction of the first housing 11. The lower end of the first connecting leg portion 56*a* is connected using, for example, solder to a connecting pad linked to a conductive trace in the first board. The conductive trace is typically a signal line.

Figure 1B:
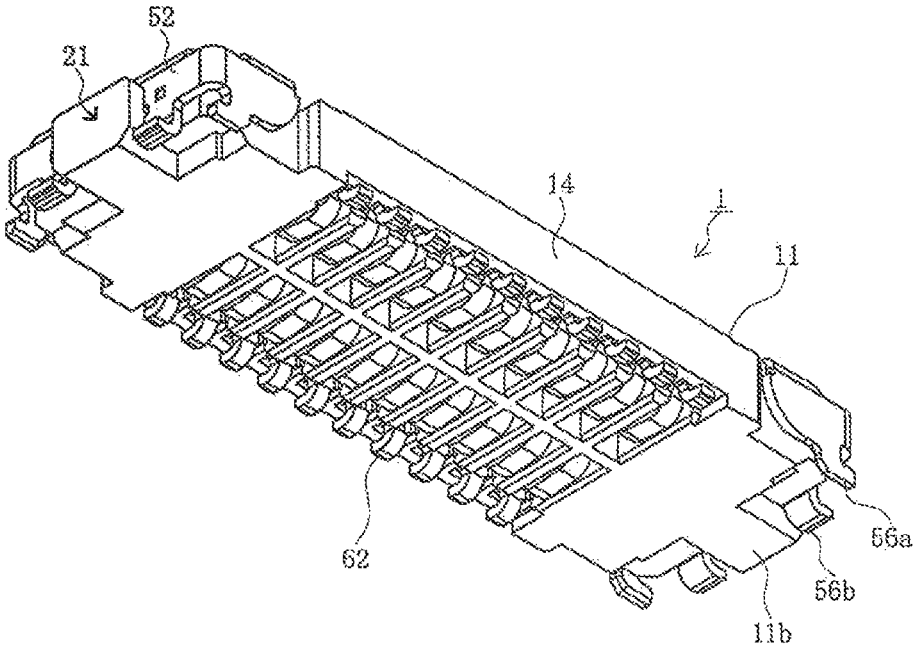

The contact upper arm portion 54A is connected at the base end to the upper end of the connecting arm portion 53 and is curved 180 degrees so that the leading end is facing downward. It includes an upper covering portion 54*a* passing over the side wall extending portion 21*c* and an inner covering portion 54*b* connected at the base end to the leading end of the upper covering portion 54*a*, extending downward, and arranged inside the side wall extending portion 21*c*. The upper covering portion 54*a* is formed so as to cover a portion of the upper surface of the side wall extending portion 21*c* when the first reinforcing metal fitting 51 is mounted on the first protruding end portion 21 as shown in FIGS. 1A and 1B.

The contact front arm portion 54B is connected at the base end to the lower front end of the inner covering portion 54*b* (that is, the inner end in the longitudinal direction of the first housing 11), and extends inward in the longitudinal direction of the first housing 11. The contact front arm portion 54B includes a curved protruding portion 54*c* which bulges inward in the longitudinal direction of the first housing 11. The curved protruding portion 54*c* comes into contact with the contact side panel portion 155 of the second reinforcing metal fitting 151 when the first connector 1 and the second connector 101 are mated.

Because the first reinforcing metal fitting 51 is an integrally formed component obtained by machining a metal strip, it has elasticity. The plate thickness of the first reinforcing metal fitting 51 is the same along the entire piece. It is clear from the shape that the interval between the left and right curved protruding portions 54*c* is elastically displaceable. In other words, when a second terminal 151 on the second connector 101 is inserted between the left and right curved protruding portions 54*c*, the gap between the left and right curved protruding portions 54*c* is extended elastically.

As mentioned above, the lower end of the first connecting leg portion 56*a* and the lower end of the second connecting leg portion 56*b* are secured to connecting pads on the first board. Therefore, the curved protruding portion 54*c* of the contact upper arm portion 54B functions as an elastically displaceable spring in the two connecting leg portions from the lower end of the first connecting leg portion 56*a* near the curved protruding portion 54*c* to the curved protruding portion 54*c* of the contact front arm portion 54B. In other words, the spring length of the total section including the first connecting leg portion 56*a*, the connecting arm portion 53, the contact upper arm portion 54A, and the contact front arm portion 54B is the distance along the section from the lower end of the first connecting leg portion 56*a* to the curved protruding portion 54*c*.

In the present embodiment, the first connecting leg portion 56*a* with a substantially L-shaped profile when viewed from the first connector 1 is connected at the base end to the lower end of the connecting arm portion 53 (that is, the outer end of the first housing 11 in the longitudinal direction) and extends outward at the leading end in the longitudinal direction of the first housing 11. As a result, the spring length, or the distance from the lower end of the first connecting leg portion 56*a* to the curved protruding portion 54*c* can be extended, and the amount of elastic displacement of the curved protruding portion 54*c* of the contact front arm portion 54B can be increased. Therefore, the curved protruding portion 54*c* can maintain reliable contact with the contact side panel portion 155 of the second reinforcing metal fitting 151.

When the contact pads of the first board secured to the lower end of the first connecting leg portion 56*a* and the lower end of the second connecting leg portion 56*b* are connected to a power line, the first reinforcing metal fitting 51 functions as a power terminal, and current flows into the first reinforcing metal fitting 51. Here, the current from the lower end of the second connecting leg portion 56*b* and the current from the lower end of the first connecting leg portion 56*a* converge at the connecting arm portion 53 and flow into the contact front arm portion 54B.

Figure 4:
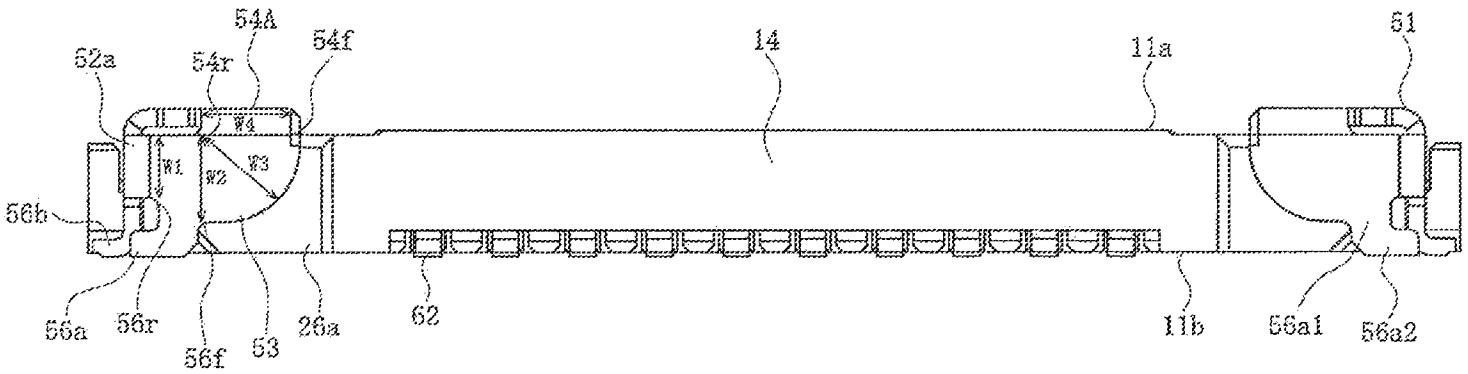
FIG. 4 is a side view of the first connector in an embodiment of the present disclosure.

The width dimension of the connecting arm portion 53 in the present embodiment is shown in FIG. 4. At the base end of the connecting arm portion 53, that is, the section connected to the corner portion 52*a* of the first main body portion 52, the width dimension W2 of the connected section at the front end 56*f* of the first connecting leg portion 56*a* is greater than the width dimension W1 of the connected section at the rear end 56*r* of the first connecting leg portion 56*a*. The width dimension from the connected section of the first main body portion 52 with the second connecting leg portion 56*b* to the leading end of the corner portion 52*a* is roughly equal to width dimension W1. The width dimension W4 of the leading end of the connecting arm portion 53, that is, the upper end connected to the contact upper arm portion 54A, which is the section in which the front end 54*f* and the rear end 54*r* of the contact upper arm portion 54A are connected, is roughly equal to width dimension W2. The entire width dimension from the base end to the leading end of the contact upper arm portion 54A is roughly equal to width dimension W4. The external shape of the lower end or the leading end of the connecting arm portion 53 is arc centered on the rear end 54*r* of the contact upper arm portion 54A. However, the radial dimension W3 is somewhat greater than width dimension W1.

The width of the section of the connecting arm portion 53 closer to the leading end than the front end 56*f* of the first connecting leg portion 56*a* and the contact arm portion 54, more specifically, the width from the section of the connecting arm portion 53 closer to the leading end than the front end 56*f* of the first connecting leg portion 56*a* to the contact upper arm portion 54A, is greater than the width from the section in which the second connecting leg portion 56*b* makes contact with the first main body portion 52 to the base end of the contact front arm portion 54B. Therefore, the width is great enough even when current from the lower end of the second connecting leg portion 56*b* and current from the lower end of the first connecting leg portion 56*a* meet and even more current flows towards the contact front arm portion 54B. This reduces resistance and eliminates heat problems.

The first connecting leg portion 56*a* is a flat plate that is flush with the connecting arm portion 53 and extends in the longitudinal direction and in the thickness direction of the first housing 11. It does not protrude outward in the transverse direction of the first housing 11. As a result, the mounting surface area of the first connector 1 on the first board is not increased. Also, because the first connecting leg portion 56*a* has an L-shaped profile from the side of the first connector 1, the area of the lower end connected to a connecting pad on the first board can be increased. Therefore, the first connecting leg portion 56*a* can be more reliably secured to the connecting pad, and the connecting resistance between the first connecting leg portion 56*a* and the connecting pad can be reduced.

As shown in FIGS. 5A-5F, a barrier portion 58 is preferably formed on the upper and lower side surfaces of the connecting arm portion 53 including the first connecting leg portion 56*a* and on the upper and lower side surfaces of the first main body portion 52 including the second connecting leg portion 56*b* to prevent solder or flux overflow. The barrier portion 58 is a band-shaped member extending in the longitudinal direction of the connecting arm portion 53 including the first connecting leg portion 56*a* and the transverse direction of the first main body portion 52 including the second connecting leg portion 56*b*, and prevents solder or flux overflow when the first connecting leg portion 56*a* and the second connecting leg portion 56*b* are connected to connecting pads on the first board and the molten solder or molten flux rises along the side surfaces of the first connecting leg portion 56*a* and the second connecting leg portion 56*b*.

More specifically, the first reinforcing metal fitting 51 is a metal plate which has been plated using a nickel (Ni) undercoating. When the upper and lower side surfaces of the connecting arm portion 53 including the first connecting leg portion 56*a* and the upper and lower side surfaces of the first main body portion 52 including the second connecting leg portion 56*b* are then plated with gold (Au), the components are exposed to a laser beam 59 as shown in FIGS. 5B, 5D, 5E and 5F to melt the gold in the sections exposed to the laser beam 59, expose the nickel, and form a barrier portion 58.

Figure 5D:
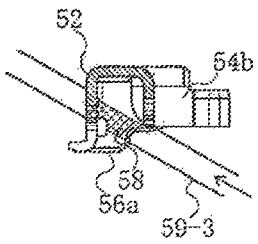
Figure 5C:
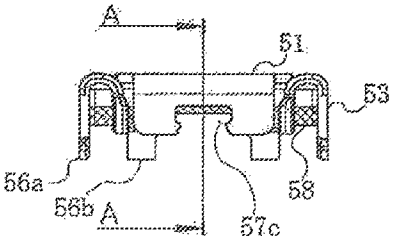
Figure 5E:
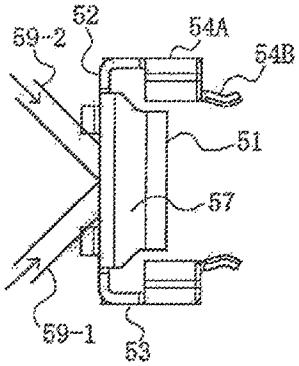
Figure 5B:
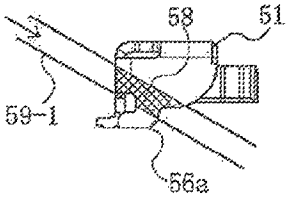
Figure 5F:
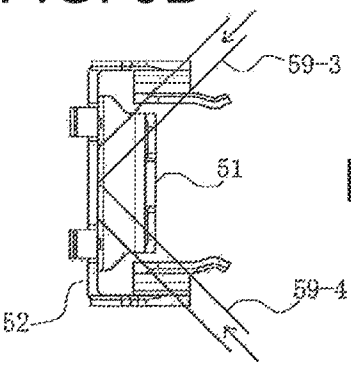
Figure 5A:
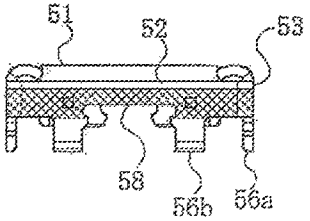

For example, by moving the first reinforcing metal fitting 51 from above to below as shown in FIG. 5E with respect to the laser beams 59-1 and 59-2 emitting light at an angle as shown in FIGS. 5B and 5E, a barrier portion 58 can be formed on the upper side surfaces of the connecting arm portion 53 including the first connecting leg portion 56*a* and the first main body portion 52 including the second connecting leg portion 56*b*. Also, by moving the first reinforcing metal fitting 51 from above to below as shown in FIG. 5F with respect to the laser beams 59-3 and 59-4 emitting light at an angle as shown in FIGS. 5D and 5F, a barrier portion 58 can be formed on the lower side surfaces of the connecting arm portion 53 including the first connecting leg portion 56*a* and the first main body portion 52 including the second connecting leg portion 56*b*. Then laser beams 59-1 through 59-4 are explained below, they may be referred to collectively as the laser beams 59.

Here, the first connecting leg portion 56*a* with an L-shaped profile when viewed from the side of the first connector 1 is a flat plate that is flush with the connecting arm portion 53 and extends in the longitudinal direction and in the thickness direction of the first housing 11. It is connected to the lower end of the connecting arm portion 53 or the outer end in the longitudinal direction of the first housing 11 and the leading end faces outward in the longitudinal direction of the first housing 11. As a result, the lower end of the first connecting leg portion 56*a* is not exposed to the laser beams 59. Because a barrier portion 58 is thus not formed on the lower end of the first connecting leg portion 56*a*, the lower end of the first connecting leg portion 56*a* can be reliably soldered to a connecting pad linked to a conductive trace on the first board.

When the first reinforcing metal fitting 51 is mounted on the first protruding end portion 21, the central guide portion 57 covers a portion of the upper surface of the inner wall portion 21*f* and the inner surface of the end wall portion 21*b*. The central guide portion 57 includes an upper covering portion 57*a* whose base end is connected to the upper end of the first main body portion 52 and whose leading end curves downward at an angle, and an inner covering portion 57*b* connected at the base end to the leading end of the upper covering portion 57*a* and extending downward at the leading end.

A protruding portion accommodating opening 57*c* for accommodating the inner end protruding portion 25 is formed in the central portion at the lower end of the inner covering portion 57*b*. In this way, the opposing flat portion 25*a* is exposed inside the mating recessed portion 22 even when the first reinforcing metal fitting 51 is mounted on the first protruding end portion 21. By mating the protruding portion accommodating opening 57*c* with the inner end protruding portion 25, the first reinforcing metal fitting 51 is positioned relative to the first protruding end portion 21.

The following is an explanation of the configuration of the second connector 101.

Figure 7:
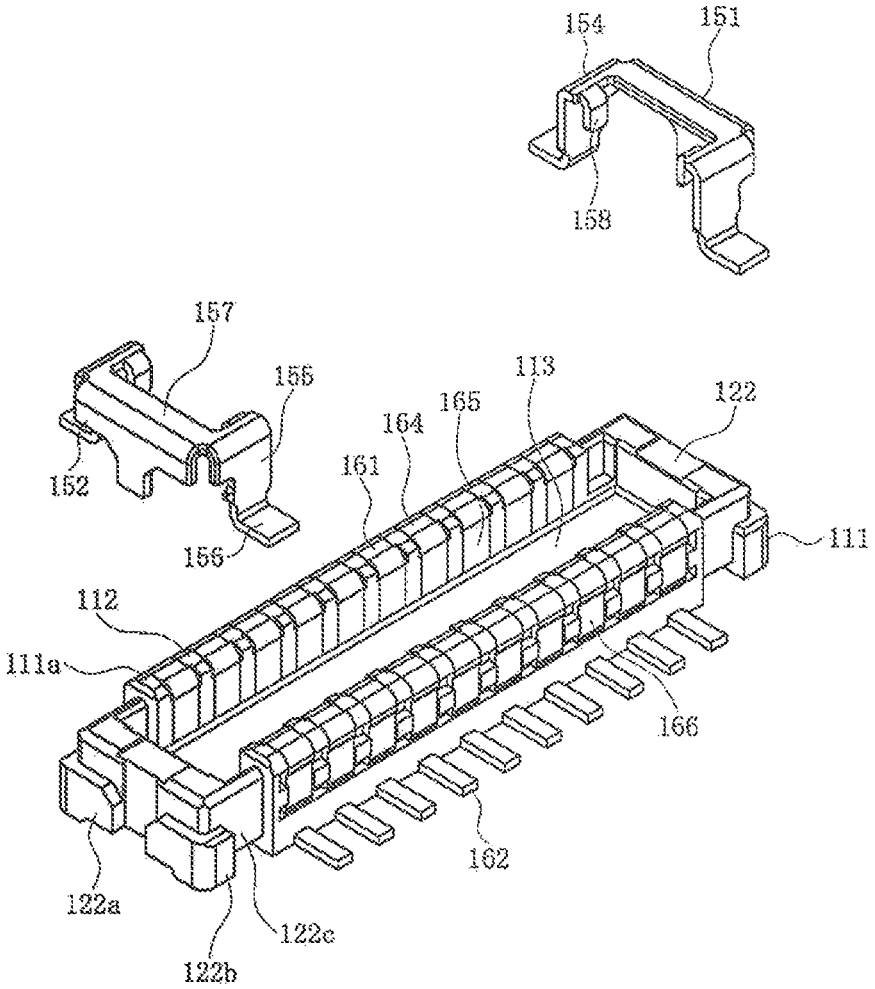
FIG. 7 is an exploded perspective view from above of the second connector in an embodiment of the present disclosure.

The second connector 101 has a second housing 111, which is the integrally molded second connector main body made of an insulating material such as a synthetic resin. As shown in the drawings, the second housing 111 has a rectangular thick panel-like shape. The second housing 111 includes an integrally formed slender recessed groove portion 113 extending in the longitudinal direction of the second housing 111 on the side mated with the first connector 1, that is, in the mating surface 111*a* side (the upper side in FIG. 7), and second protruding portions 112 serving as slender protruding portions, which define the outside of the recessed groove portion 113 and extend in the longitudinal direction of the second housing 111. The second protruding portions 112 extend along both sides of the recessed groove portion 113 and along both sides of the second housing 111.

Figure 8:
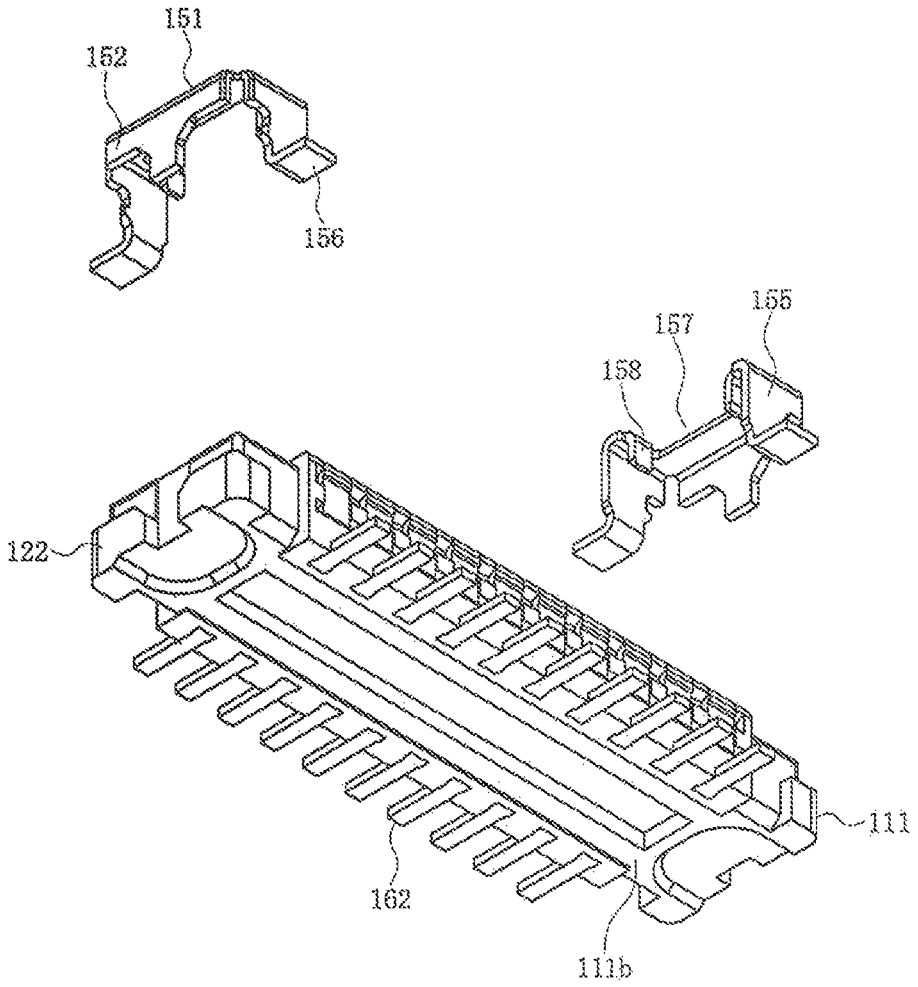
FIG. 8 is an exploded perspective view from below of the second connector in an embodiment of the present disclosure.

Each second protruding portion 112 includes an opposing second terminal 161. The pitch, number and arrangement of second terminals 161 correspond to those of the first terminals 61. The recessed groove portion 113 is closed by a bottom plate on the side mounted on the second board, that is, on the mounting surface 111*b* (the lower end in FIG. 8).

Each second terminal 161 is an integrally formed conductive metal plate which has been stamped and bent, and has a main body portion (not shown), a tail portion 162 connected to the bottom end of the main body, a first contact portion 165 connected to the upper end of the main body portion, a connecting portion 164 connected to the upper end of the first contact portion 165, and a second contact portion 166 formed on the outer end of the connecting portion 164.

The main body portion (not shown) is held in and surrounded by the second housing 111. The tail portion 162 extends in the transverse direction of the main body portion, that is, the width direction of the second housing 111, and is connected using, for example solder to a connecting pad linked to a conductive trace on the second board. The conductive trace is typically a signal line.

The second terminals 161 are integrally molded with the second housing 111 using a molding method such as overmolding or insert molding. In other words, the second terminals 161 are set inside the second housing 111 and the mold cavity is filled with an insulating material. In this way, each second terminal 161 is integrally attached to the second housing 111 so that the main body is embedded in the second housing 111, but the surfaces of the first contact portion 165, the connecting portion 164, and the second contact portion 166 are exposed on the side surfaces of the second protruding portions 112 and the mating surface 111*a*.

A second protruding end portion 122 serving as a mating guide portion is provided on both ends of the second housing 111 in the longitudinal direction. The second protruding end portions 122 are thick components extending in the transverse direction of the second housing 111, and both ends are connected to each second protruding portion 112 in the longitudinal direction. When the first connector 1 and the second connector 101 are mated, the second protruding end portions 122 function as insertion protruding portions for insertion into the protruding end recessed portions 22 of the first protruding end portions 21 in the first connector 1.

The second protruding end portion 122 includes side wall portions 122*b* extending in the longitudinal direction of the second housing 111, an end wall portion 122*a* connected at both ends to a side wall portion 122*b*, and a reinforcing metal fitting accommodating recessed portion 122*c*. The second reinforcing metal fitting 151 is accommodated inside a reinforcing metal fitting accommodating recessed portion 122*c* and mounted on the second protruding end portion 122.

In the present embodiment, the second reinforcing metal fitting 151 is an integrally formed component obtained by stamping and bending a metal sheet, and includes a slender, band-shaped second main body portion 152 extending in the transverse direction of the second housing 111, a central covering portion 157 connected to the upper end of the second main body portion 152, a side covering portion 154 connected to both the left and right ends of the central covering portion 157, a holding protruding piece 158 connected to a side edge of the side covering portion 154, a contact side panel portion 155 connected to the other end of the side covering portion 154, and a board connecting portion 156 connected to the lower end of the contact side panel portion 155.

Figure 6A:
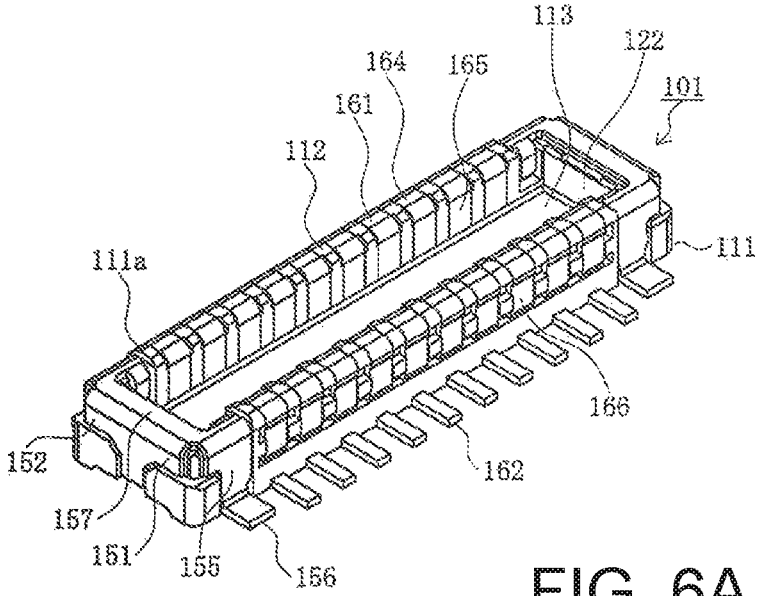
Figure 6B:
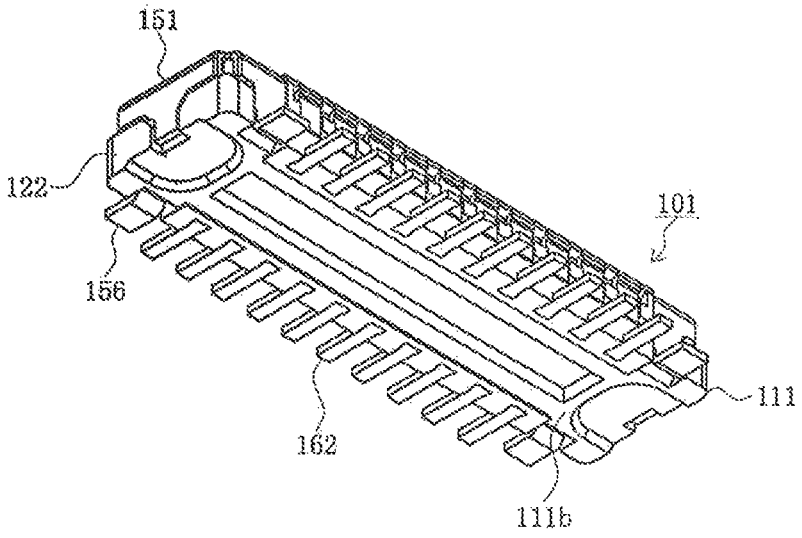

The central covering portion 157 has the right size and shape to cover most of the upper surface of the second protruding end portion 122 when the second reinforcing metal fitting 151 is mounted on the second protruding end portion 122 as shown in FIGS. 6A and 6B.

A side covering portion 154 extends from the left and right ends of the central covering portion 157 in the longitudinal direction of the second housing 111 and runs parallel to the upper surface of the second protruding portion 112 near both ends in the longitudinal direction. A contact side panel portion 155 runs parallel to the outer side surfaces near both ends of the second protruding portion 112 in the longitudinal direction. A holding protruding piece 158 runs parallel to the inner side surfaces of the second protruding portion 112 near both ends in the longitudinal direction. The side covering portions 154 and the holding protruding pieces 158 and contact side panel portions 155 connected to both side edges form a continuous U-shaped profile.

The board connecting portion 156 extends outward from the second housing 111 and is soldered to a connecting pad lined to a conductive trace on the second board. The conductive trace is typically a power line.

The following is an explanation of the operations performed to mate a first connector 1 and a second connector 101 with these configurations.

Here, the first connector 1 is surface mounted on the first board by soldering the tail portions 62 of the first terminals 61 to connecting pads lined to conductive traces on the first board (not shown) and by soldering the first connecting leg portion 56*a* and the second connecting leg portion 56*b* of the first reinforcing metal fitting 51 to connecting pads linked to conductive traces on the first board. The conductive traces linked to connecting pads to which the tail portions 62 of the first terminals 61 are connected are signal lines, and the conductive traces linked to connecting pads to which the first connecting leg portion 56*a* and the second connecting leg portion 56*b* of the first reinforcing metal fitting 51 are soldered are power lines.

Similarly, the second connector 101 is surface mounted on the second board (not shown) by connecting the tail portions 162 of the second terminals 161 using, for example, solder to the connecting pads linked to the conductive traces of the second board, and by connecting the board connecting portion 156 of the second reinforcing metal fitting 151 to conductive traces on the second board. The conductive traces linked to the connecting pads that are connected to the tail portions 162 of the narrow second terminals 161B are signal lines, and the conductive traces linked to the connecting pads that are connected to the board connecting portion 156 of the second reinforcing metal fitting 151 are power lines.

First, the operator brings the mating surface 11*a* of the first housing 11 of the first connector 1 opposite the mating surface 111*a* of the second housing 111 of the second connector 101, aligns the positions of the second protruding portions 112 of the second connector 101 with the positions of the corresponding recessed groove portions 12*a* in the first connector 1, and aligns the positions of the second protruding end portions 122 of the second connector 101 with the positions of the corresponding protruding end recessed portions 22 of the first connector 1 to complete the positioning of the first connector 1 and the second connector 101.

Figure 9A:
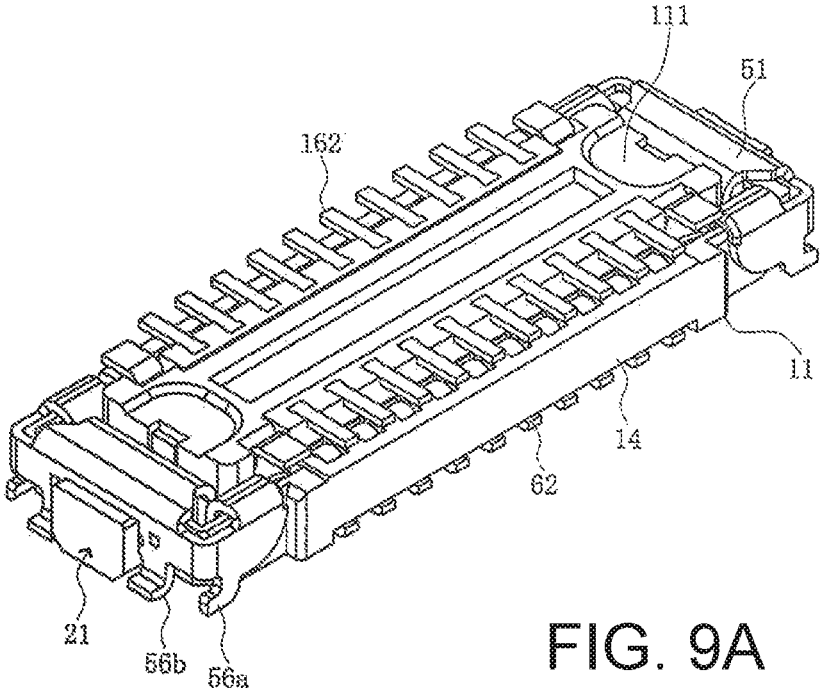
Figure 9B:
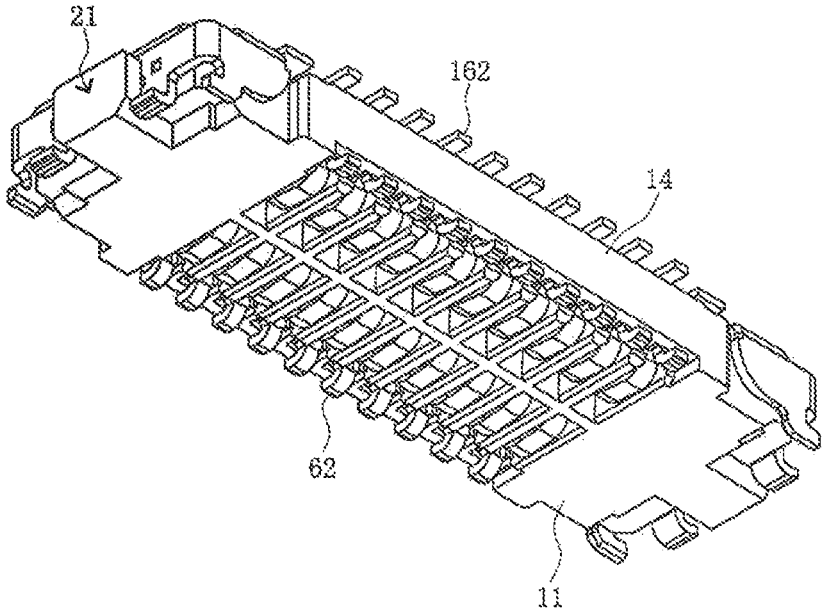

The first connector 1 and/or second connector 101 is moved closer to the other connector, that is, in the mating direction, and the second protruding portions 112 and the second protruding end portions 122 of the second connector 101 are inserted into the recessed groove portions 12*a* and mating recessed portions 22 of the first connector 1. In this way, as shown in FIGS. 9A and 9B, an electrical connection is established between the first terminals 61 and the second terminals 161 when the first connector 1 and the second connector 101 have been mated.

More specifically, each second terminal 161 on the second connector 101 is inserted between the first contact portion 65 and second contact portion 66 of a first terminal 61, the first contact portion 65 of the first terminal 61 and the first contact portion 165 of the second terminal 161 come into contact, and the second contact portion 66 of the first terminal 61 and the second contact portion 166 of the second terminal 161 come into contact. As a result, the conductive traces linked to the connecting pads of the first board connected to the tail portions 62 of the first terminals 61 and the conductive traces linked to the connecting pads of the second board connected to the tail portions 162 of the second terminals 161 establish an electrical connection.

The spring action of each first terminal 61 causes the first contact portion 65 and the second contact portion 66 to clamp a second terminal 161 on both sides. Because each second terminal 161 is securely held by a first terminal 61, the second terminals 161 do not become detached from the first terminals 61, and the first connector 1 and the second connector 101 remain mated.

Because the first connector 1 and the second connector 101 are mounted, respectively, on a wide-area first board and second board, the operator cannot see the mating surface of the first connector 1 and the mating surface of the second connector 101, and must perform the mating operation by groping about. Because the connectors cannot be properly aligned simply by groping about, the first connector 1 and the second connector 101 are sometimes misaligned. When the first connector 1 and the second connector 101 are misaligned, the bating surface of the second connector 101 may be tilted relative to the mating surface of the first connector 1.

Figure 2:
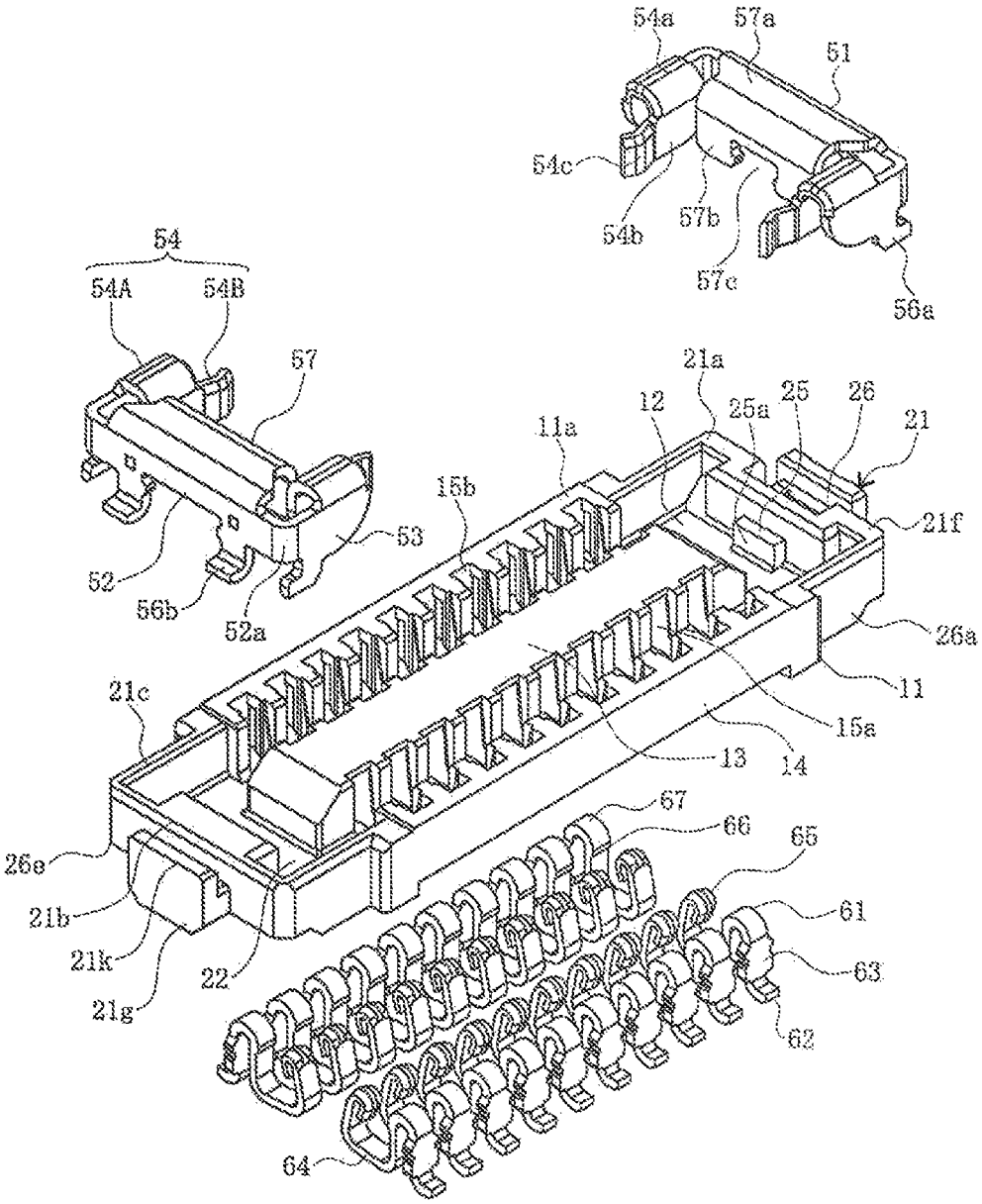
FIG. 2 is an exploded perspective view from above of the first connector in an embodiment of the present disclosure.

In this situation, when the operator moves the first connector 1 and/or the second connector 101 towards the other connector in the mating direction, one of the second protruding end portions 122 of the second connector 101 comes into contact with one of the first protruding end portions 21 of the first connector 1, and the first protruding end portion 21 is strongly pressed against the second protruding end portion 122 in the mating direction, that is, downward in FIG. 2.

However, in the present embodiment, a first reinforcing metal fitting 51 is mounted on the first protruding end portions 21 and each first protruding end portion 21 is covered by the central guide portion 57 and the contact upper arm portion 54A of the first reinforcing metal fitting 51. Thus, the pressure is transmitted to the first board via the first connecting leg portion 56*a* and the second connecting leg portion 56*b* of the first reinforcing metal fitting 51 even when strongly pressed against by the second protruding end portion 122. Hardly any of the pressure is transmitted to the first protruding end portion 21. As a result, the first protruding end portion 21 is not broken or damaged.

Also, a second reinforcing metal fitting 151 is mounted on the second protruding end portions 122 and each second protruding end portion 122 is covered by the central covering portion 157 and the side covering portion 154 of the second reinforcing metal fitting 151. Thus, the pressure is transmitted to the second board via the board connecting portion 156 even when strongly pressed against by the first protruding end portion 21. Hardly any of the pressure is transmitted to the second protruding end portion 122. As a result, the second protruding end portion 122 is not broken or damaged.

When the first connector 1 and the second connector 101 have been mated, an electrical connection is established between the first terminals 61 and the second terminals 161, and the first reinforcing metal fitting 51 on the first connector 1 is engaged with the second reinforcing metal fitting 151 on the second connector 101. In this way, an electrical connection is established between the first reinforcing metal fitting 51 and the second reinforcing metal fitting 151 and a power line connection can be maintained.

Figure 10A:
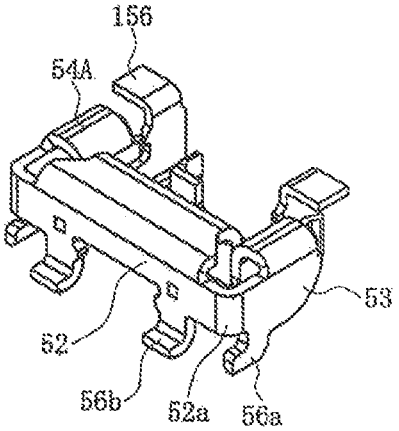
Figure 10A:
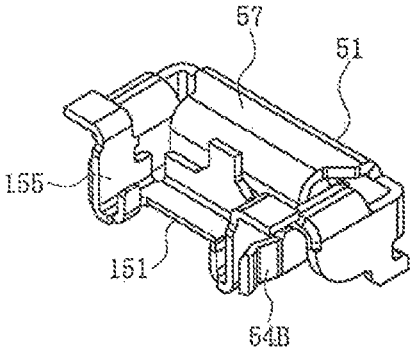
Figure 10B:
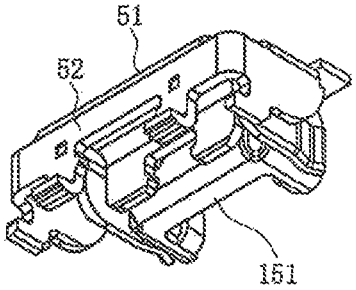
Figure 10B:
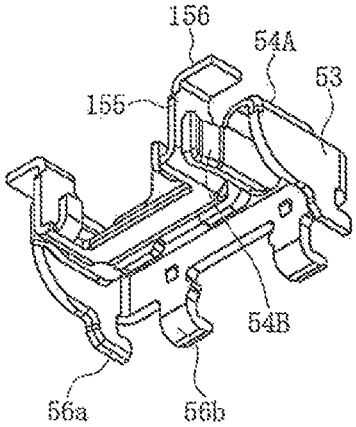
Figure 11A:
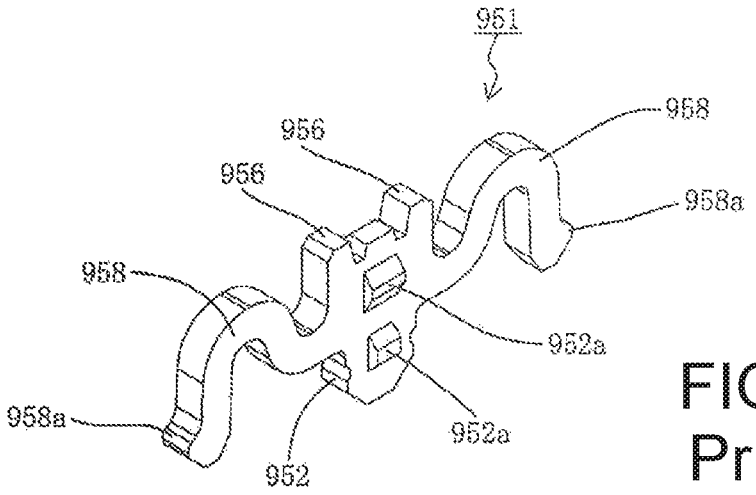
FIG. 11A Prior Art
Figure 11B:
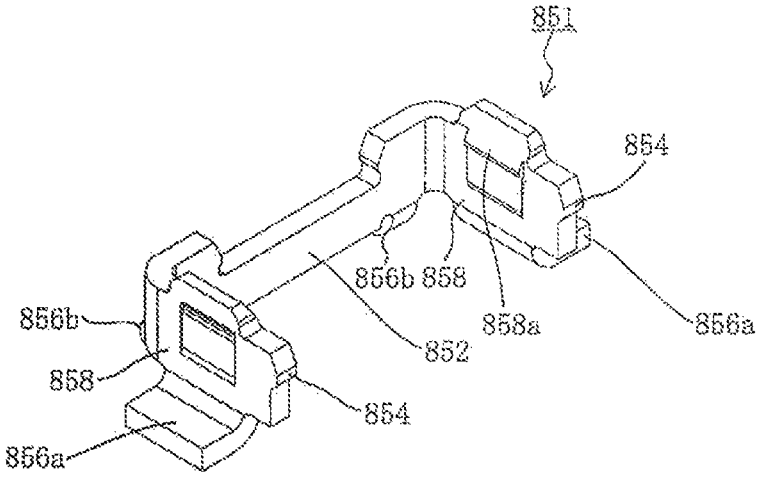
FIG. 11B Prior Art

More specifically, as shown in FIGS. 10A and 10B, the second reinforcing metal fitting 151 is inserted into the first reinforcing metal fitting 51, and the curved protruding portions 54*c* on the left and right contact front arm portion 54B of the first reinforcing metal fitting 51 make contact with the left and right contact side panel portions 155 of the second reinforcing metal fitting 151. At this time, the left and right curved protruding portions 54*c* are pushed apart by the left and right contact side panel portions 155 of the second reinforcing metal fitting 151, and are displaced outward, that is, outward in the transverse direction of the first housing 11. The spring action of the contact front arm portion 54B, the contact upper arm portion 54A connected to the contact front arm portion 54B, and the connecting arm portion 53 connected to the contact upper arm portion 54A presses the surface of the curved protruding portions 54*c* against the surface of the contact side panel portions 155.

Because reliable contact can be made between the surfaces of the curved protruding portions 54*c* and the surfaces of the contact side panel portion 155, a reliable electrical connection can be established between the first reinforcing metal fitting 51 and the second reinforcing metal fitting 151.

Here, the first reinforcing metal fitting 51 has a long spring length extending through the first connecting leg portion 56*a*, the connecting arm portion 53, the contact upper arm portion 54A, and the contact front arm portion 54B. Therefore, the curved protruding portions 54 are greatly displaced elastically at the free end in the section extending from the first connecting leg portion 56*a* to the contact front arm portion 54B which is the spring portion with a long spring length. Thus, when the electronic device including the first board and the second board is dropped and sustains vibrations from a strong external impact, the second reinforcing metal fitting 151 may become displaced relative to the first reinforcing metal fitting 51, but contact is maintained by the curved protruding portions 54*c* despite displacement of the contact side panel portions 155, an electrical connection is reliably maintained between the first reinforcing metal fitting 51 and the second reinforcing metal fitting 151, and a short or temporary cutoff of electricity does not occur.

Because the first connecting leg portion 56*a* and the second connecting leg portion 56*b* of the first reinforcing metal fitting 51 are connected to connecting pads linked to the power line of the first board, a strong current is received. The current from the first connecting leg portion 56*a* and the current from second connecting leg portion 56*b* converge at the connecting arm portion 53 and flow towards the contact front arm portion 54B. However, the width dimension from the section of the contact front arm portion 54B closer to the leading end than the front end 56*f* of the first connecting leg portion 56*a* to the leading end of the contact upper arm portion 54A is greater than the width dimension from the section of the first main body portion 52 connected to the second connecting leg portion 56*b* to the contact front arm portion 54B. Therefore, even though the current from the second connecting leg portion 56*b* converges with the current from the first connecting leg portion 56*a* and the larger current flows towards the contact front arm portion 54B, the larger width dimension along the pathway reduces the conductive resistance and eliminates the heat problem. As described above, the section from the first connecting leg portion 56*a* to the contact front arm portion 54B is longer because of the greater spring length, and also has a greater width dimension. This, too, reduces the conductive resistance and eliminates the heat problem.

In the present embodiment, the first connector 1 includes a first housing 11, first terminals 61 mounted in the first housing 11, and a first reinforcing metal fitting 51 mounted in the first housing 11. The first housing 11 has first protruding end portions 21 connected at both ends in the longitudinal direction, and the first protruding end portions 21 are mated with the second protruding end portions 122 formed at both ends of the second housing 111 of the second conductor 101 in the longitudinal direction. The first reinforcing metal fitting 51 includes a first main body portion 52 secured to the first protruding end portions 21, a pair of left and right connecting arm portions 53 connected to the base ends on both the left and right ends of the first main body portion 52, extending in the longitudinal direction of the first housing 11, and arranged to the outside of the side wall extending portions 21*b* of the first protruding end portions 21, and a pair of left and right contact arm portions 54 connected at the base ends to the upper end or leading end of the connecting arm portions 53, and contacting the second reinforcing metal fixture 151 mounted in the second housing 111. The lower end or base end of a connecting arm portion 53 is connected to the upper end of a first connecting leg portion 56*a* connected to a connecting pad on the first board. The first connecting leg portion 56*a* has a substantially L-shaped profile when viewed from the side of the first connector 1.

In this way, the spring length can be extended to the section making contact with the second reinforcing metal fixture 151, the mating of the first reinforcing metal fixture 51 and the second reinforcing metal fixture 151 can be reliably maintained, the electrical connection between the first reinforcing metal fixture 51 and the second reinforcing metal fixture 151 can be reliably maintained. In other words, reliability is improved overall.

The first connecting leg portion 56*a* includes a perpendicular portion 56*a*1 extending in the vertical direction, and a horizontal portion 56*a*2 extending from the perpendicular portion 56*a*1 outward in the longitudinal direction of the first housing 11. The lower end of the horizontal portion 56*a*2 is connected to a connecting pad. Therefore, the surface area connected to the connecting pad can be increased, the connection to the connecting pad is more secure, and the connecting resistance between the first connecting leg portion 56*a* and the connecting pad can be reduced.

The lower end of the first main body portion 52 is connected to the upper end of a second connecting leg portion 56*b* connected to a connecting pad on the first board. The second connecting leg portion 56*b* has a substantially L-shaped profile when viewed from the side of the first connector 1. Because a second connecting leg portion 56*b* is connected to a connecting pad on the first board in addition to the first connecting leg portion 56*a*, the connection strength between the first reinforcing metal fitting 51 and the first board can be improved. Also, because there are multiple locations for the flow of current, the conductive resistance can be reduced.

The width of the connecting arm portion 53 in the section in front of the front end 56*f* of the first connecting leg portion 56*a* is greater than the width of the base end connected to the first main body portion 52. Because the section of the connecting arm portion 53 is wider where there is a confluence with the current from the first connecting leg portion 56*a*, the conductive resistance can be held down.

The width of the contact arm portion 54 is greater than the width of the connecting arm portion 53 at the base end connected to the first main body portion 52. Because the section making contact with the second reinforcing metal fitting 151 can be lengthened and widened, the conductive resistance can be held down.

The side surfaces of the first main body portion 52 and the connecting arm portion 53 are plated with a nickel undercoating, and then plated with gold. The gold plating is then exposed to a laser beam 59 to expose nickel on the surface and, thus, create a barrier portion 58. Because a laser beam 59 is used, a barrier portion 58 can be easily formed to prevent solder or flux overflow.

The present disclosure is not limited to the embodiments described above. Many modifications and variations are possible without departing from the spirit and scope of the present disclosure.

The present disclosure can be applied to a connector.

The invention claimed is:

1. A connector comprising:

a connector main body, the connector main body including mating guide portions formed at both ends longitudinally, the mating guide portions having left and right side wall portions;

terminals mounted in the connector main body; and a reinforcing metal fitting mounted in the connector main body, the reinforcing metal fitting including a main body portion secured to one of the mating guide portions, a pair of left and right connecting arm portions connected to a base end of the main body portion on both left and right ends of the main body portion, the left connecting arm portion being arranged outside of the left side wall portion of the mating guide portion, the right connecting arm portion being arranged outside of the right side wall portion of the mating guide portion, a pair of left and right contact arm portions, the left contact arm portion being connected at a base end thereof to an upper or leading end of the left connecting arm portion, the right contact arm portion being connected at a base end thereof to an upper or leading end of the right connecting arm portion, and a pair of first connecting leg portions, a first one of the first connecting leg portions being connected at an upper end thereof to a lower or base end of the left connecting arm portion, a second one of the first connecting leg portions being connected at an upper end thereof to a lower or base end of the right connecting arm portion, wherein the reinforcing metal fitting has a barrier portion formed on at least a portion of each of the first and second ones of the first connecting leg portions.

2. The connector according to claim 1, wherein each contact arm portion has a contact upper arm portion, the contact upper arm portion including an upper covering portion connected at a base end thereof to the upper or leading end of the respective connecting arm portion, and an inner covering portion connected to a leading end of the upper covering portion.

3. The connector according to claim 2, wherein each contact arm portion has a contact front arm portion, the contact front arm portion being connected to the inner covering portion.

4. The connector according to claim 1, wherein each first connecting leg portion includes a perpendicular portion extending in a vertical direction and a horizontal portion extending from the perpendicular portion outward in the longitudinal direction of the connector main body.

5. The connector according to claim 4, wherein a second connecting leg portion is connected at an upper end thereof to a lower end of the main body portion.

6. The connector according to claim 1, wherein the reinforcing metal fitting is plated with nickel undercoating, and wherein at least one surface of each of the connecting arm portions are plated with gold, and wherein the barrier portion is formed by melting at least a portion of the gold with a laser beam to expose the nickel undercoating.

7. A connector comprising:

a connector main body, the connector main body including a mating guide portion formed at a longitudinal end thereof, the mating guide portion having an end wall portion extending in a transverse direction and left and right side wall portions connected to the end wall portion and extending in a longitudinal direction, the mating guide portion further having an inner end protruding portion which extends inwardly from a central portion of the end wall portion in the longitudinal direction and an outer wall portion which extends outwardly from the central portion of the end wall portion in the longitudinal direction;

terminals mounted in the connector main body; and a reinforcing metal fitting mounted in the connector main body, the reinforcing metal fitting including a main body portion secured to the outer wall portion of the mating guide portion, a central guide portion, the central guide portion being connected at a base end thereof to an upper end of the main body portion, the central guide portion being secured to the inner end protruding portion of the mating guide portion, a pair of left and right connecting arm portions connected to a base end of the main body portion on both left and right ends of the main body portion, the left connecting arm portion being arranged outside of the left side wall portion of the mating guide portion, the right connecting arm portion being arranged outside of the right side wall portion of the mating guide portion, a pair of left and right contact arm portions, the left contact arm portion being connected at a base end thereof to an upper or leading end of the left connecting arm portion, the right contact arm portion being connected at a base end thereof to an upper or leading end of the right connecting arm portion, and a pair of first connecting leg portions, a first one of the first connecting leg portions being connected at an upper end thereof to a lower or base end of the left connecting arm portion, a second one of the first connecting leg portions being connected at an upper end thereof to a lower or base end of the right connecting arm portion.

8. The connector according to claim 7, wherein each first connecting leg portion includes a perpendicular portion extending in a vertical direction and a horizontal portion extending from the perpendicular portion outward in the longitudinal direction of the connector main body.

9. The connector according to claim 8, wherein a second connecting leg portion is connected at an upper end thereof to a lower end of the main body portion.

10. The connector according to claim 7, wherein each contact arm portion has a contact upper arm portion and a contact front arm portion, the contact upper arm portion including an upper covering portion connected at a base end thereof to the upper or leading end of the respective connecting arm portion, and an inner covering portion connected to a leading end of the upper covering portion, and the contact front arm portion being connected to the inner covering portion.

11. The connector according to claim 7, wherein a barrier portion is formed on upper and lower side surfaces of the connecting arm portions to prevent the rise of solder or flux.

12. The connector according to claim 11, wherein the reinforcing metal fitting is plated with nickel undercoating, and wherein the upper and lower side surfaces of the connecting arm portions are plated with gold, and wherein the barrier portion is formed by melting at least a portion of the gold with a laser beam to expose the nickel undercoating.

13. The connector according to claim 7, wherein each contact arm portion has a contact upper arm portion, the contact upper arm portion including an upper covering portion connected at a base end thereof to the upper or leading end of the respective connecting arm portion, and an inner covering portion connected to a leading end of the upper covering portion.

14. The connector according to claim 13, wherein a barrier portion is formed on at least a portion of each of the first and second ones of the first connecting leg portions.

15. The connector according to claim 14, wherein the reinforcing metal fitting is plated with nickel undercoating, and wherein at least one surface of each of the connecting arm portions are plated with gold, and wherein the barrier portion is formed by melting at least a portion of the gold with a laser beam to expose the nickel undercoating.

* * * * *